US011730276B2

(12) United States Patent
Huang

(10) Patent No.: US 11,730,276 B2
(45) Date of Patent: Aug. 22, 2023

(54) FOLDABLE BED

(71) Applicant: Xiamen Roadzup Outdoor Products Co., Ltd., Xiamen (CN)

(72) Inventor: Changjiu Huang, Xiamen (CN)

(73) Assignee: Xiamen Roadzup Outdoor Products Co., Ltd., Xiamen (CN)

( * ) Notice: Subject to any disclaimer, the term of this patent is extended or adjusted under 35 U.S.C. 154(b) by 23 days.

(21) Appl. No.: 17/230,213

(22) Filed: Apr. 14, 2021

(65) Prior Publication Data

US 2022/0079349 A1 Mar. 17, 2022

(30) Foreign Application Priority Data

Sep. 16, 2020 (CN) ..... 202010975823.1

(51) Int. Cl.
*A47C 19/12* (2006.01)

(52) U.S. Cl.
CPC ..... *A47C 19/12* (2013.01)

(58) Field of Classification Search
CPC ..... A47C 19/12; A47C 19/122; A47C 19/02
USPC ..... 5/178
See application file for complete search history.

(56) References Cited

U.S. PATENT DOCUMENTS 464,524 A * 12/1891 Segar ..... A47C 19/128 5/178
564,465 A * 7/1896 Antisdel ..... A47C 17/40 5/178
1,070,525 A * 8/1913 Pieper ..... F16M 11/04 248/281.11
1,196,253 A * 8/1916 Lowy ..... A47C 19/122 5/154
1,360,983 A * 11/1920 Burton ..... A47C 19/122 5/154
1,408,015 A * 2/1922 Luppino ..... A47C 19/122 5/180
1,476,279 A * 12/1923 Basford ..... A47C 19/122 5/310
1,566,574 A * 12/1925 Berg ..... A47C 17/66 5/178
1,572,241 A * 2/1926 McDonald ..... A47C 19/122 5/191
1,659,941 A * 2/1928 Cable ..... A47C 19/122 5/310
1,667,080 A * 4/1928 Ramsey ..... A61G 7/0528 5/154
1,732,476 A * 10/1929 Kolb ..... A47C 17/40 5/178
1,742,197 A * 1/1930 Calvano ..... A47C 19/122 5/154

(Continued)

*Primary Examiner* — David R Hare
*Assistant Examiner* — Luke Hall
(74) *Attorney, Agent, or Firm* — Cooper Legal Group, LLC

(57) ABSTRACT

A foldable bed comprises a bed surface unit, one or more first support legs, a first linkage bar, and a second linkage bar. A four-bar linkage is defined by the bed surface unit, the one or more first support legs, the first linkage bar, and the second linkage bar, and the four-bar linkage is configured to be changed to be alternatively in a folded state or a supporting state. A first triangular support structure is defined by the first linkage bar, the bed surface unit, and the one or more first support legs, and a second triangular support structure is defined by the second linkage bar, the bed surface unit, and the one or more first support legs.

10 Claims, 10 Drawing Sheets

(56) References Cited

U.S. PATENT DOCUMENTS 1,743,332 A * 1/1930 Ellsworth ..... A47C 19/12 5/112
1,814,828 A * 7/1931 Chackes ..... A47C 19/122 5/162
2,306,337 A * 12/1942 Hampton ..... A47C 19/122 5/152
2,513,168 A * 6/1950 Gottlieb ..... A47C 19/122 5/111
2,764,412 A * 9/1956 Dunham ..... A63B 21/00047 5/178
2,982,973 A * 5/1961 Faver ..... A47C 19/122 5/4
3,245,363 A * 4/1966 Kanitz ..... A47B 3/087 182/15
3,296,633 A * 1/1967 Rieger ..... A47D 11/007 5/99.1
5,029,349 A * 7/1991 Hamilton ..... A47C 1/143 5/631
6,151,730 A * 11/2000 Weston ..... A47C 19/122 5/112
6,625,827 B1 * 9/2003 Polevoy ..... A47C 19/02 5/305
9,314,386 B1 * 4/2016 Boyd ..... A47C 19/122
10,285,506 B2 * 5/2019 Choi ..... A47C 19/024
2001/0004777 A1 * 6/2001 Hernandez ..... A47C 19/025 5/200.1
2009/0100597 A1 * 4/2009 Oh ..... A47C 21/02 5/176.1
2009/0249546 A1 * 10/2009 Yul ..... A47C 19/126 5/115
2010/0005587 A1 * 1/2010 Choi ..... A47C 19/122 5/202
2011/0099712 A1 * 5/2011 Jin ..... A47C 19/122 5/174
2011/0126352 A1 * 6/2011 Choi ..... A47C 19/122 5/174
2012/0222216 A1 * 9/2012 Jin ..... A47C 19/122 5/400
2013/0038094 A1 * 2/2013 Chen ..... A47C 7/006 297/42
2013/0312185 A1 * 11/2013 Suh ..... A47C 20/043 5/618
2014/0338710 A1 * 11/2014 Huang ..... E04H 15/32 135/120.3
2015/0250325 A1 * 9/2015 Lee ..... A47C 19/024 5/200.1
2016/0157620 A1 * 6/2016 Oh ..... A47C 19/024 5/312
2016/0206110 A1 * 7/2016 Oh ..... A47C 19/12
2016/0206112 A1 * 7/2016 Oh ..... A47C 19/126
2017/0119166 A1 * 5/2017 An ..... A47C 17/40
2017/0172307 A1 * 6/2017 Choi ..... A47C 19/024
2017/0215597 A1 * 8/2017 Jin ..... A47C 19/122
2017/0215598 A1 * 8/2017 Choi ..... A47C 19/04
2017/0273466 A1 * 9/2017 Salin ..... A47C 17/28
2017/0347805 A1 * 12/2017 Choi ..... A47C 19/024
2017/0362853 A1 * 12/2017 Huang ..... E04H 15/322
2018/0000254 A1 * 1/2018 Jin ..... A47C 17/70
2018/0055235 A1 * 3/2018 Choi ..... A47C 19/12
2018/0055236 A1 * 3/2018 Choi ..... A47C 19/122
2018/0110339 A1 * 4/2018 Moon ..... A47C 19/122
2018/0125253 A1 * 5/2018 Choi ..... A47G 9/0292
2018/0125255 A1 * 5/2018 Jin ..... A47C 19/024
2018/0271296 A1 * 9/2018 Harrow ..... A47C 19/025
2018/0332973 A1 * 11/2018 Choi ..... A47C 19/025

* cited by examiner

FOLDABLE BED

RELATED APPLICATIONS

This application claims priority to Chinese patent application number 202010975823.1, filed on Sep. 16, 2020. Chinese patent application number 202010975823.1 is incorporated herein by reference.

FIELD OF THE DISCLOSURE

The present disclosure relates to a technical field of household products or camping products, and more particularly to a foldable bed.

BACKGROUND OF THE DISCLOSURE

There are two types of existing foldable beds. With reference to FIG. 1, a first type of foldable bed comprises a bed surface unit, two bed frames A, and a middle support leg B. The bed surface unit comprises two bed frames C, and inner sides of the two bed frames C are rotatably connected to the middle support leg B. A first linkage bar D1 and a second linkage bar D2 are connected between each of the two bed frames A and each of the two bed frames C to define a four-bar linkage, and the four-bar linkage is changed between a collapsed state and a supported state. In the collapsed state, the two bed frames A are folded on a back of the two bed frames C. In the supported state, an upper part of each of the two bed frames A extends above a corresponding one of the two bed frames C to define a stop portion, and the two bed frames C are supported on the first linkage bar D1. Therefore, there are the following shortcomings: (1) each of the two bed frames C, the first linkage bar D1, the second linkage bar D2, and each of the two bed frames A still cooperatively define the four-bar linkage when in the supported state, which has a poor supporting strength; (2) the two bed frames C are supported on the first linkage bar D1, a weight of the two bed frames C is supported by the first linkage bar D1, the weight of the two bed frames C and the first linkage bar D1 is supported by a pivot shaft at which the first linkage bar D1 is pivotally connected to each of the two bed frames A, and the pivot shaft has a poor supporting strength; and (3) the two bed frames A are far apart, which has a poor supporting strength.

A second type of foldable bed comprises a bed surface unit, two supporting legs disposed on both sides of the bed surface unit, a middle support leg, and a locking mechanism. The bed surface unit comprises two bed surface frames whose inner sides are rotatably connected to the middle support leg. Each of the two supporting legs is rotatably connected to each of the two bed surface frames and the locking mechanism connects each of the two supporting legs and each of the two bed surface frames to maintain a locked state. Therefore, there are the following shortcomings: (1) the locking mechanism must be maintained in the locked state; and (2) a weight of each of the two bed surface frames is supported by a pivot shaft at which each of the two supporting legs is pivotally connected to each of the two bed surface frames, and the pivot shaft has a poor supporting strength.

BRIEF SUMMARY OF THE DISCLOSURE

The present disclosure provides a foldable bed to solve the deficiencies in the background.

In order to solve the technical problem, a technical solution of the present disclosure is as follows.

A foldable bed comprises a bed surface unit, one or more first support legs, a first linkage bar, and a second linkage bar. The first linkage bar and the second linkage bar are respectively connected between the bed surface unit and the one or more first support legs. A length of the first linkage bar is shorter than a length of the second linkage bar. Two ends of the first linkage bar are respectively pivotally connected to the bed surface unit and the one or more first support legs. Two ends of the second linkage bar are respectively pivotally connected to the bed surface unit and the one or more first support legs. A first position on which the first linkage bar is pivotally connected to the one or more first support legs is higher than a second position on which the second linkage bar is pivotally connected to the one or more first support legs. A four-bar linkage is defined by the bed surface unit, the one or more first support legs, the first linkage bar, and the second linkage bar, and the four-bar linkage is configured to be changed to be alternatively in a folded state or a supporting state. When the four-bar linkage is in the folded state, the one or more first support legs are folded on a back of the bed surface unit. When the four-bar linkage is in the supporting state, a top end surface of the one or more first support legs supports a bottom surface of the bed surface unit, a first triangular support structure is defined by the first linkage bar, the bed surface unit, and the one or more first support legs, and a second triangular support structure is defined by the second linkage bar, the bed surface unit, and the one or more first support legs.

In a preferred embodiment, the first linkage bar is pivotally connected to an upper part of the one or more first support legs.

In a preferred embodiment, the bottom surface of the bed surface unit is disposed with a support beam. When the four-bar linkage is in the supporting state, the top end surface of the one or more first support legs support a bottom surface of the support beam, and the one or more first support legs are perpendicular to the bed surface unit.

In a preferred embodiment, a locking mechanism is connected between the bed surface unit and the one or more first support legs to enable the one or more first support legs to be locked or unlocked in the supporting state.

In a preferred embodiment, the locking mechanism comprises a locking plate configured to slide on the bed surface unit, an elastic member biasing the locking plate, and a protruding member protruding on the one or more first support legs, and the locking plate comprises a locking hook cooperating with the protruding member to control the locking mechanism to achieve locking or unlocking by sliding of the locking plate.

In a preferred embodiment, the locking plate comprises a guiding surface, and the protruding member is configured to abut the guiding surface to push the locking hook to slide.

In a preferred embodiment, the one or more first support legs are two first support legs, both sides of the bed surface unit are connected with the two first support legs, and the first linkage bar and the second linkage bar are respectively connected between the bed surface unit and each of the two first support legs.

In a preferred embodiment, the foldable bed comprises a second support leg, the bed surface unit comprises two bed surface frames, the second support leg is both pivotally connected to inner sides of the two bed surface frames, and each of the two bed surface frames is connected with each of the two first support legs.

In a preferred embodiment, a position-limited device is connected between the second support leg and the two bed surface frames, the position-limited device comprises two support rods, first ends of the two support rods are respectively pivotally connected to the two bed surface frames, second ends of the two support rods cooperate with the second support leg to define a slidable and pivotable connection, and a limiting mechanism for limiting the second ends of the two support rods from sliding upward beyond a highest position is disposed between the second ends of the two support rods and the second support leg.

In a preferred embodiment, a sliding sleeve is slidably connected to the second support leg, and the second ends of the two support rods are both pivotally connected to the sliding sleeve.

Compared with the existing techniques, the technical solution has the following advantages.

A first feature: the bed surface unit, the one or more first support legs, the first linkage bar, and the second linkage bar cooperatively initially define the four-bar linkage and then define the first triangular support structure and the second triangular support structure in the supporting state. A second feature: the top end surface of the one or more first support legs directly supports the bottom surface of the bed surface unit. The first feature and the second feature are combined to achieve the following technical effects: 1) the foldable bed has a high support strength, high stability, and long service life; 2) the one or more first support legs can only be folded up by raising the bed surface unit, are in a self-locked state due to gravity, and are more stable in the supporting state after bearing a weight due to the self-locked state; and 3) during the folding process, the top end surface of the one or more first support legs leaves a supported area of the bed surface unit, which is reasonable in layout and causes the foldable bed have a compact structure when in the folded state.

The locking plate comprises a locking hook cooperating with the protruding member to control the locking mechanism to achieve locking or unlocking by sliding of the locking plate.

DETAILED DESCRIPTION OF THE EMBODIMENTS

Figure 1:
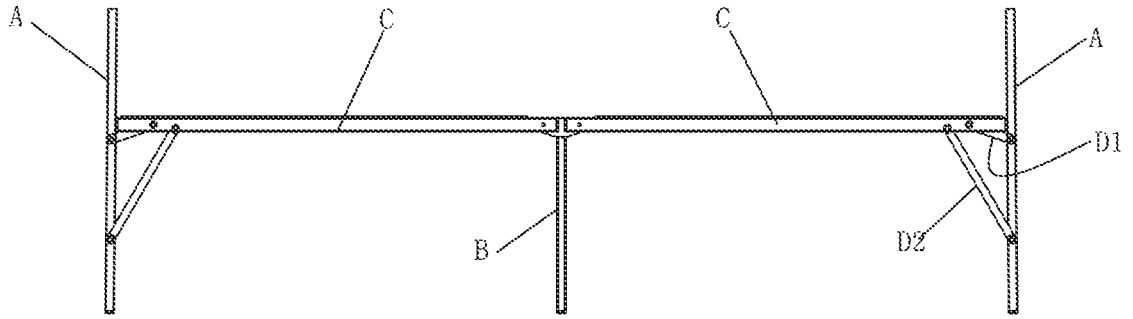
FIG. 1 (Prior Art)
FIG. 1 illustrates a structure diagram of a first type of foldable bed in the prior art.
Figure 2:
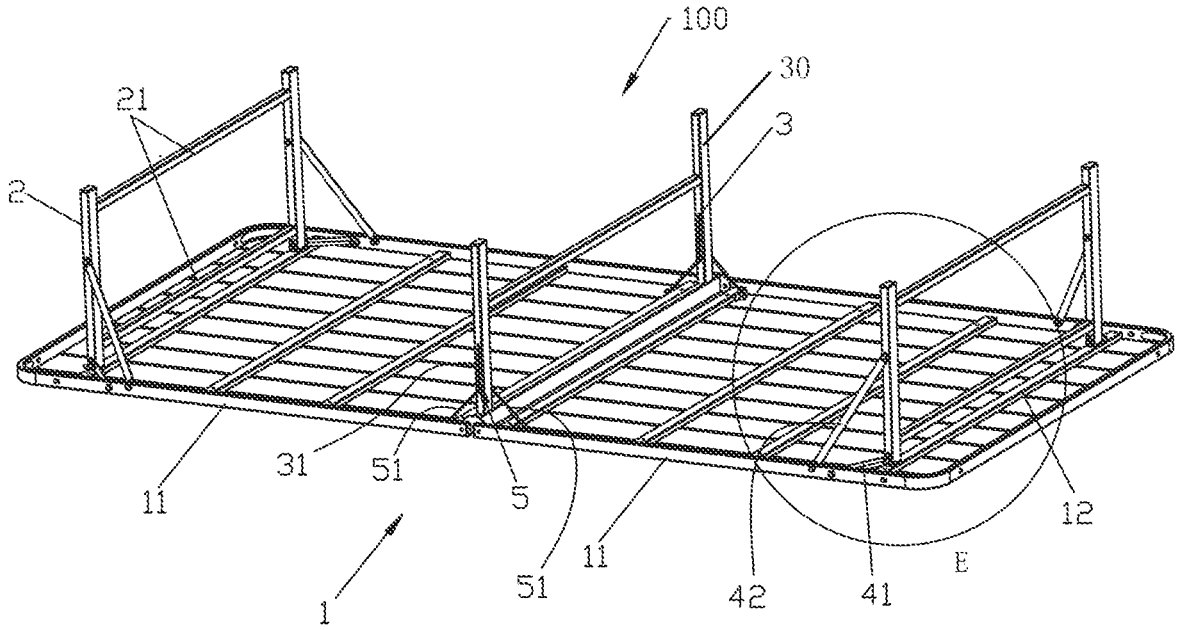
FIG. 2 illustrates a first perspective view of a foldable bed according to embodiment 1 when the foldable bed is in a supporting state.
Figure 3:
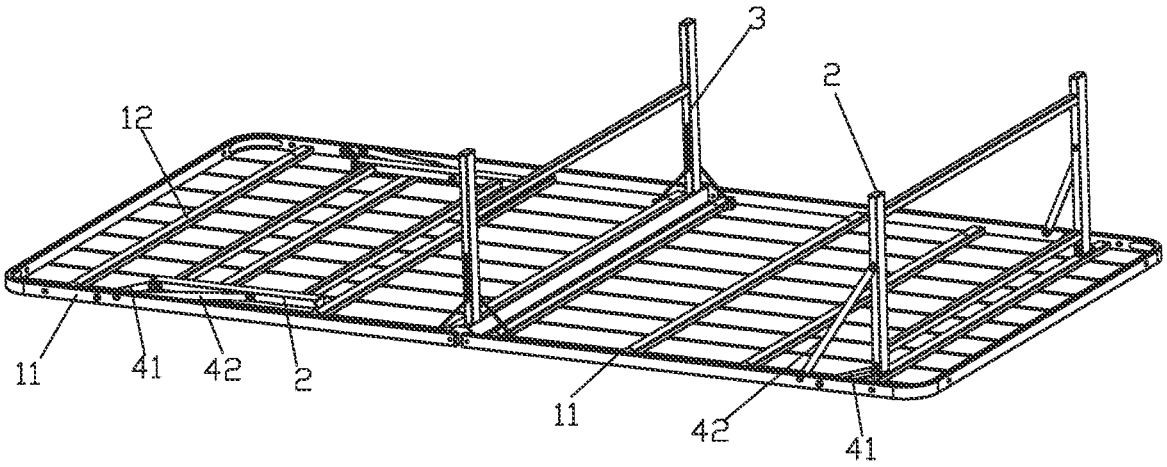
FIG. 3 illustrates a second perspective view of the foldable bed according to embodiment 1 when one of two first support legs is in a folded state.
Figure 4:
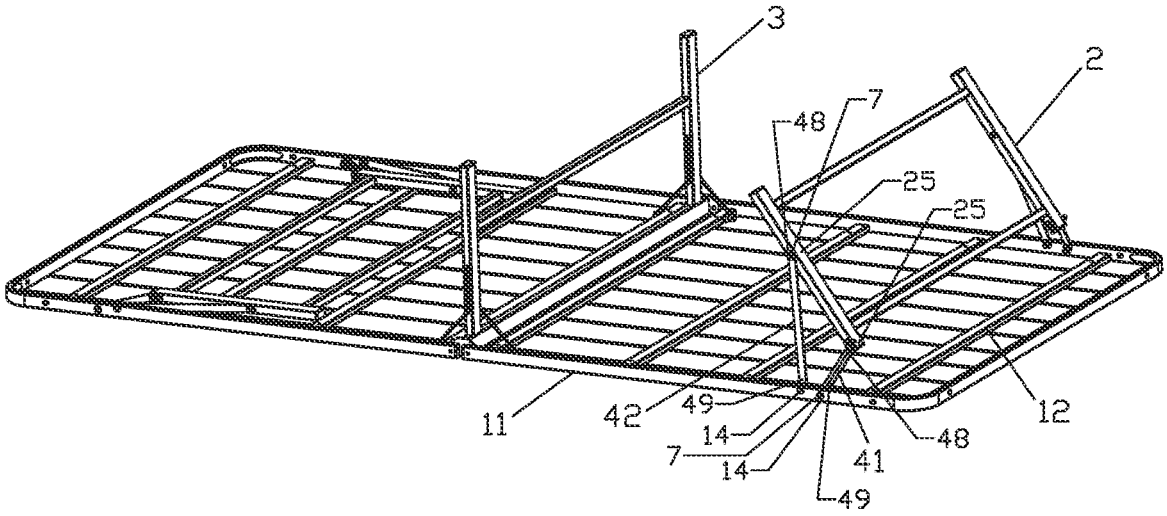
FIG. 4 illustrates a third perspective view of the foldable bed according to embodiment 1 when the other one of the two first support legs is in a half folded state.
Figure 5:
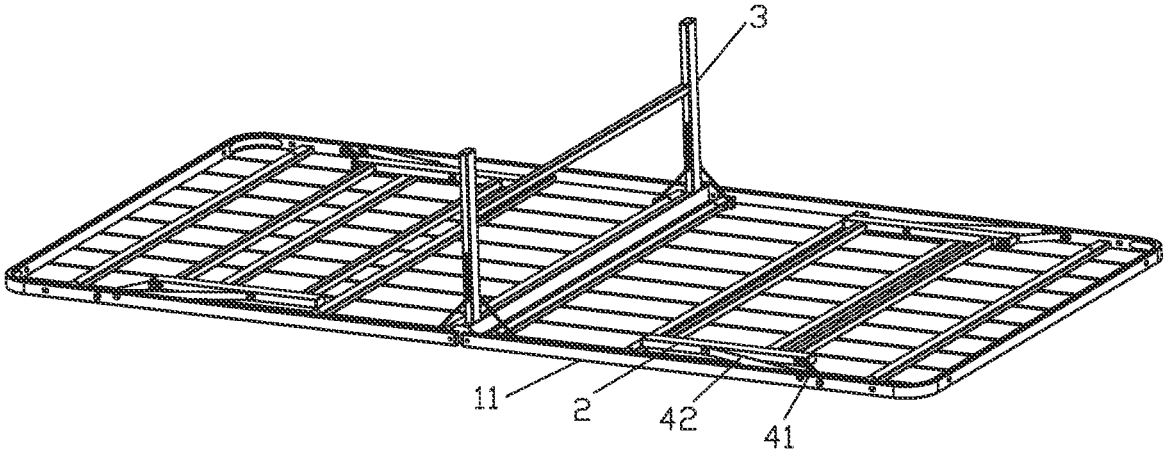
FIG. 5 illustrates a fourth perspective view of the foldable bed according to embodiment 1 when both of the two first support legs are in the folded state.
Figure 6:
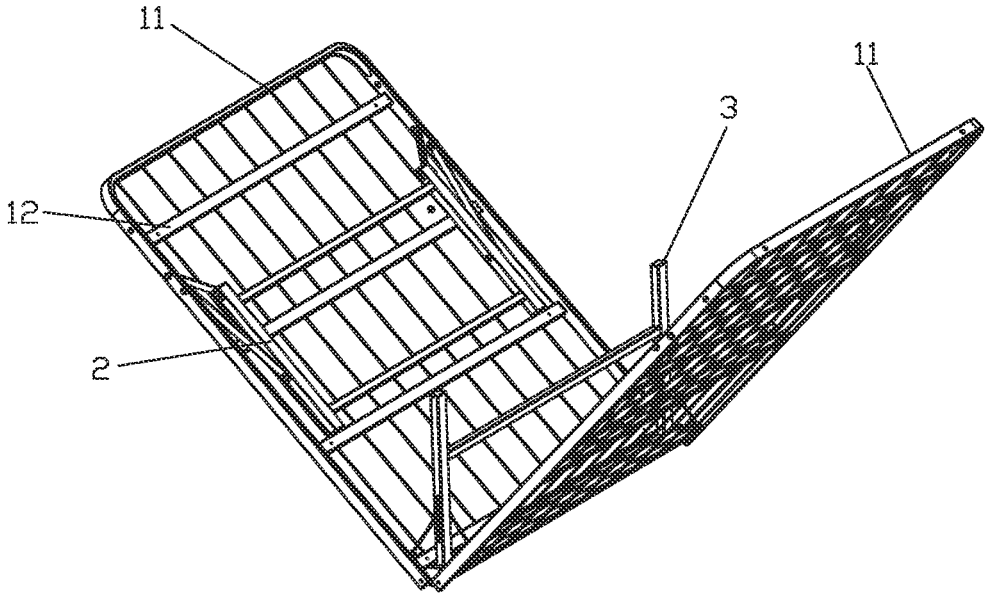
FIG. 6 illustrates a fifth perspective view of the foldable bed according to embodiment 1 when both of two bed surface frames are in a half folded state.
Figure 7:
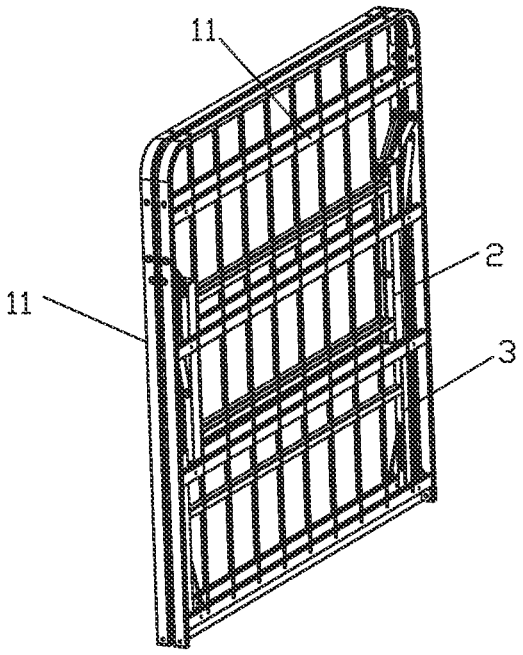
FIG. 7 illustrates a sixth perspective view of the foldable bed according to embodiment 1 when the foldable bed is in a folded state.
Figure 8:
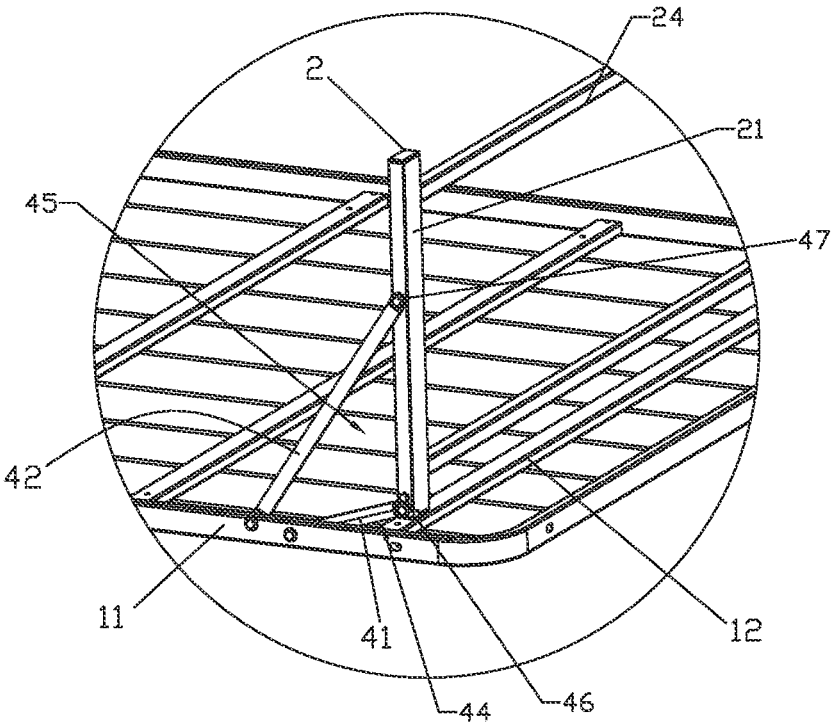
FIG. 8 illustrates an enlarged perspective view of E in FIG. 2.
Figure 9:
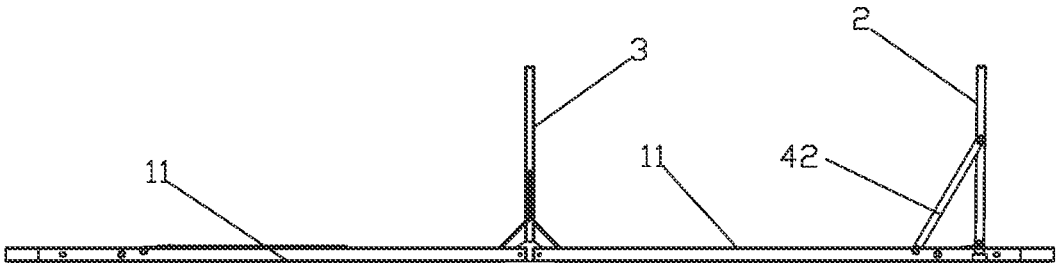
FIG. 9 illustrates a first front view of the foldable bed according to embodiment 1 when one of the two first support legs is in folded state.
Figure 10:
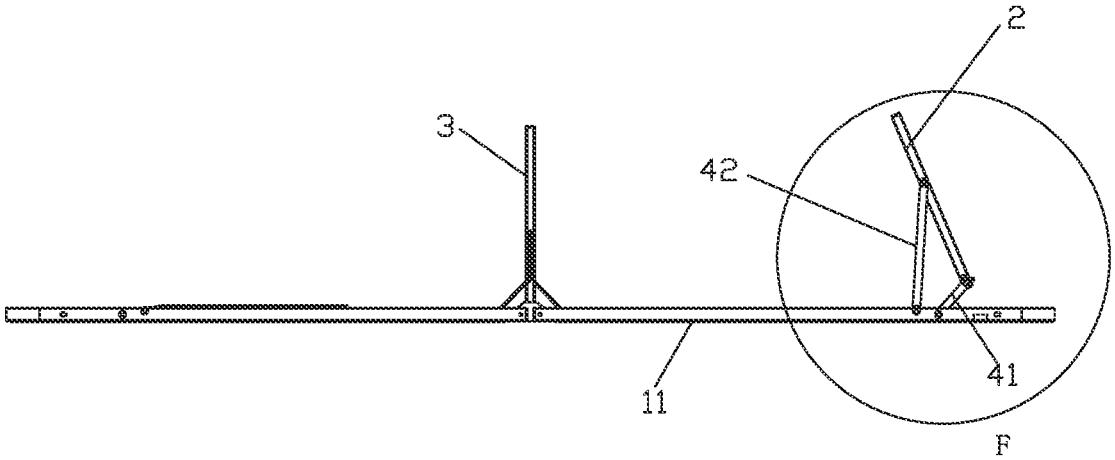
FIG. 10 illustrates a second front view of the foldable bed according to embodiment 1 when the other one of the two first support legs is in a first folding stage during a folding process.
Figure 11:
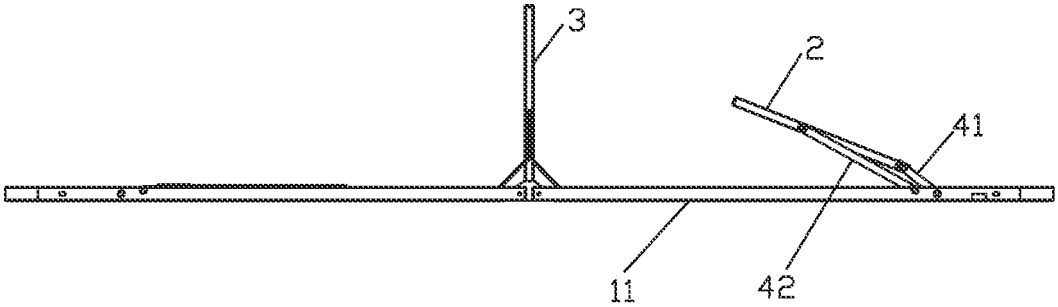
FIG. 11 illustrates a third front view of the foldable bed according to embodiment 1 when the other one of the two first support legs is in a second folding stage during the folding process.
Figure 12:
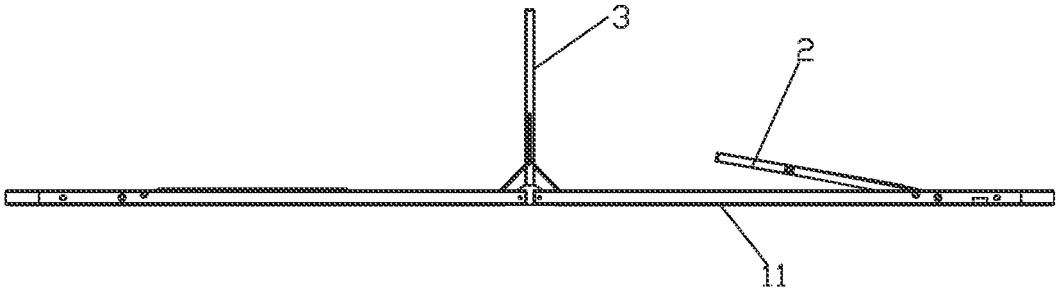
FIG. 12 illustrates a fourth front view of the foldable bed according to embodiment 1 when the other one of the two first support legs is in a third folding stage during the folding process.
Figure 13:
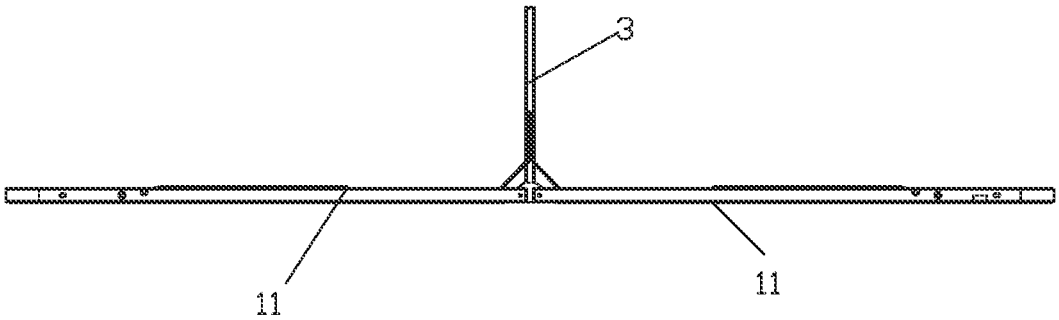
FIG. 13 illustrates a fifth front view of the foldable bed according to embodiment 1 when both of the two first support legs are in the folded state.

The present disclosure will be further described below in combination with the accompanying drawings and embodiments.

Embodiment 1

Referring to FIGS. 1-16, a foldable bed 100 is provided and comprises a bed surface unit 1, two first support legs 2, and a second support leg 3. The bed surface unit 1 comprises two bed surface frames 11, and the second support leg 3 is pivotally connected to inner sides of the two bed surface frames 11. Each of the two bed surface frames 11 is respectively connected with each of the two first support legs 2. In this embodiment, the two bed surface frames 11 are connected by the second support leg 3. In some embodiments, the two bed surface frames 11 can be replaced by a bed plate. The second support leg 3 comprises two legs 30, and each of the two legs 30 comprises a sliding groove 31.

Figure 14:
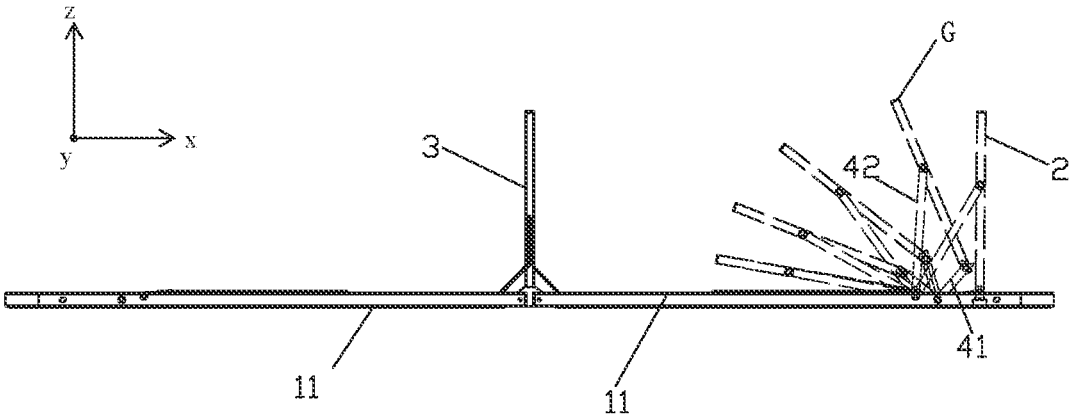
FIG. 14 illustrates a sixth front view of the foldable bed according to embodiment 1, illustrating the folding process of the other one of the two first support legs and illustrating a highest point (G point) during the folding process.
Figure 15:
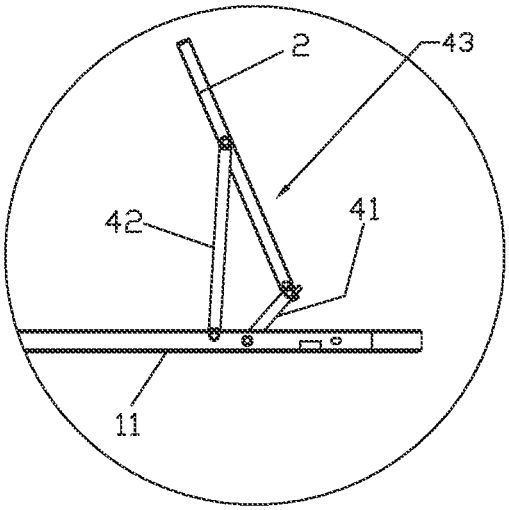
FIG. 15 illustrates an enlarged front view of F in FIG. 10 according to embodiment 1.
Figure 16:
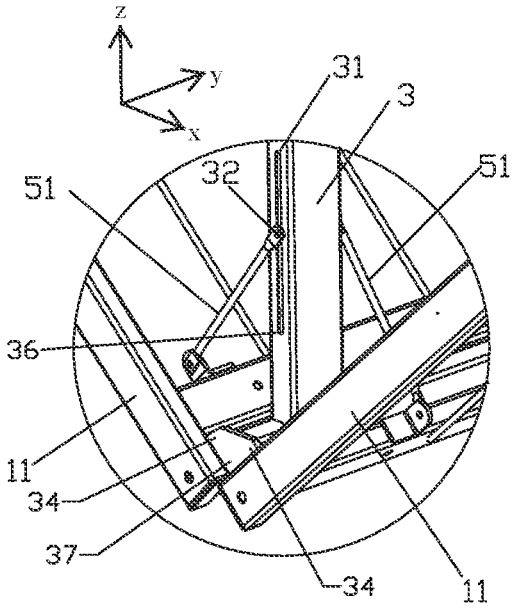
FIG. 16 illustrates an enlarged perspective view of the foldable bed according to embodiment 1.
Figure 17:
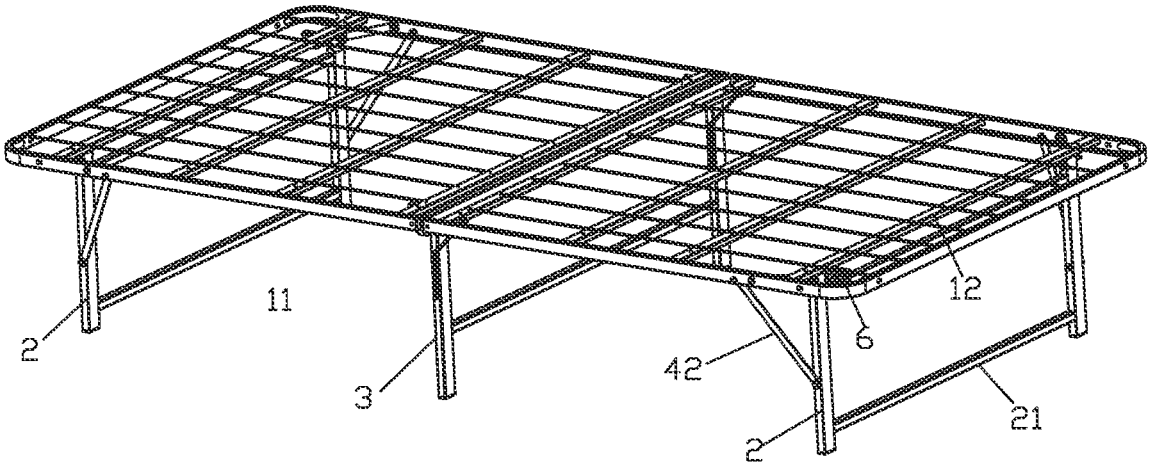
FIG. 17 illustrates a perspective view of a foldable bed according to embodiment 2.
Figure 18:
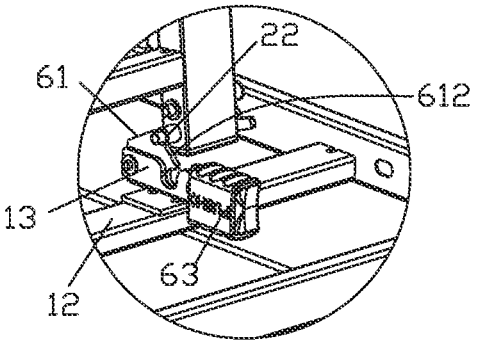
FIG. 18 illustrates a first perspective view of a locking mechanism according to embodiment 2 when the locking mechanism is in a first step of a locking process in which the locking mechanism is changed from an unlocked state to a locked state.
Figure 19:
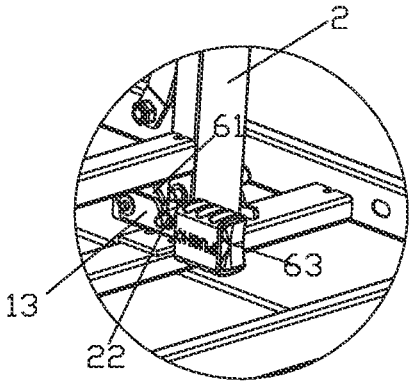
FIG. 19 illustrates a second perspective view of the locking mechanism according to embodiment 2 when the locking mechanism is in a second step of the locking process.
Figure 20:
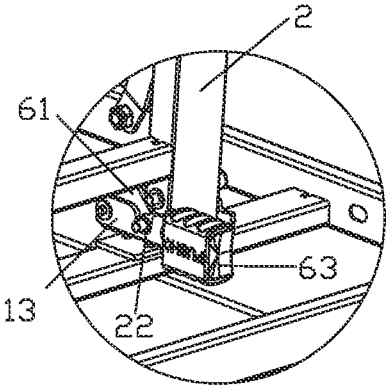
FIG. 20 illustrates a third perspective view of the locking mechanism according to embodiment 2 when the locking mechanism is in the locked state.
Figure 21:
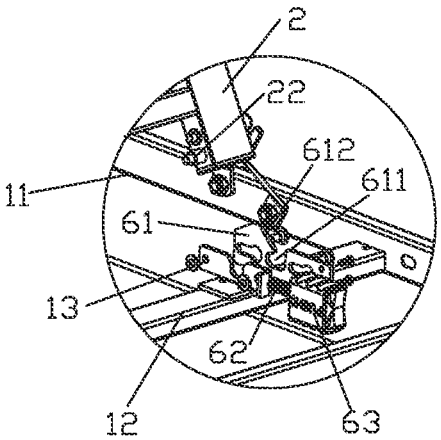
FIG. 21 illustrates an exploded structure diagram of the locking mechanism according to embodiment 2.

A first linkage bar 41 and a second linkage bar 42 are respectively connected between each of the two bed surface frames 11 and each of the two first support legs 2. Two ends of the first linkage bar 41 are respectively pivotally connected to each of the two bed surface frames 11 and each of the two first support legs 2, and two ends of the second linkage bar 42 are respectively pivotally connected to each of the two bed surface frames 11 and each of the two first support legs 2. A four-bar linkage 43 is defined by each of the two bed surface frames 11, each of the two first support legs 2, the first linkage bar 41, and the second linkage bar 42, and the four-bar linkage 43 is configured to be changed to be alternatively in a folded state or a supporting state. When the four-bar linkage 43 is in the folded state, each of the two first support legs 2 is folded on a back of each of the two bed surface frames 11. When the four-bar linkage 43 is in the supporting state, a top end surface of each of the two first support legs 2 supports a bottom surface of each of the two bed surface frames 11, a first triangular support structure 44 is defined by the first linkage bar 41, each of the two bed surface frames 11, and each of the two first support legs 2, and a second triangular support structure 45 is defined by the second linkage bar 42, each of the two bed surface frames 11, and each of the two first support legs 2. Since the first triangular support structure 44 and the second triangular support structure 45 are defined and the top end surface of each of the two first support legs 2 directly supports the bottom surface of each of the two bed surface frames 11, the foldable bed 100 is stable and reliable in the supporting state and has a high support strength and a high bearing capacity. Referring to FIG. 14, during an unfolding process in which the four-bar linkage 43 is changed from the folded state to the supporting state, a distance between a bottom end of each of the two first support legs 2 and each of the two bed surface frames 11 increases to a highest point (G point) and then decreases a little bit. During a folding process in which the four-bar linkage 43 is changed from the supporting state to the folded state, the distance between the bottom end of each of the two first support legs 2 and each of the two bed surface frames 11 increases a little bit to the highest point (G point) and then decreases. The foldable bed 100 has the following advantages: (1) each of the two first support legs 2 can only be folded up by raising each of the two bed surface frames 11, is in a self-locked state due to gravity, and is more stable in the supporting state after bearing a weight due to the self-locked state; (2) during the unfolding process, each of the two first support legs 2 can automatically move to the supporting state due to gravity or a user's weight after the bottom end of each of the two first support legs 2 passes the highest point (G point); (3) the top end surface of each of the two first support legs 2 directly supports the bottom surface of each of the two bed surface frames 11, and a weight of each of the two bed surface frames 11 is directly borne by each of the two first support legs 2 so that hinge shafts of the foldable bed 100 only serve as a connecting function and do not have a weight-bearing function. Therefore, the hinge shafts have a long service life; (4) during the folding process, the top end surface of each of the two first support legs 2 leaves a supported area of each of the two bed surface frames 11, which is reasonable in layout and causes the foldable bed 100 have a compact in structure when in the folded state. Therefore, a packaging size of the foldable bed 100 is small in the folded state, which is convenient for the transportation of bed frame products and saves a lot of transportation costs; (5) the supported area can be located on the bottom surface of each of the two bed surface frames 11, and there exists a distance between an edge of each of the two bed surface frames 11 and the top end surface of each of the two first support legs 2. On the one hand, this arrangement prevents users from kicking each of the two first support legs 2, and on the other hand, a distance between the two first support legs 2 is shortened to increase a bearing capacity of the two first support legs 2; (6) during the folding process, it is only necessary to lift up each of the two bed surface frames 11 to release gravity constraints of each of the two first support legs 2 to fold the foldable bed 100 easily and quickly; and (7) it is quick and convenient to fold or unfold the foldable bed 100. Users can quickly unfold the foldable bed 100 without any tools, so that the foldable bed 100 can be quickly folded and stored when not in use.

In the embodiment, a first position 46 on which the first linkage bar 41 is pivotally connected to each of the two first support legs 2 is higher than a second position 47 on which the second linkage bar 42 is pivotally connected to each of the two first support legs 2. The first linkage bar 41 is pivotally connected to an upper part of each of the two first support legs 2, and a length of the first linkage bar 41 is shorter than a length of the second linkage bar 42. Each of the two first support legs 2 is perpendicular to each of the two bed surface frames 11 in the supporting state, so the support strength of the foldable bed 100 is further improved and a patency of folding or unfolding of the foldable bed 100 is improved.

In some embodiments, the bottom surface of each of the two bed surface frames 11 is disposed with a support beam 12, and the top end surface of each of the two first support legs 2 supports a bottom surface of the support beam 12. Therefore, the support strength and a connecting strength of the foldable bed 100 are improved.

A position-limited device 5 is disposed and connected between the second support leg 3 and the two bed surface frames 11. Two lugs 34 are fixedly disposed symmetrically on an upper part of the second support leg 3 along a left-right direction (i.e., corresponding to the x-axis in FIG. 14). The two lugs 34 and the second support leg 3 cooperatively define a T-shaped structure, and the inner sides of the two bed surface frames 11 are respectively pivotally connected to the two lugs 34. In some embodiments, a connecting piece 37 is fixedly disposed on the upper part of the second support leg 3 and extends out of a side surface of the second support leg 3 to define the two lugs 34. The position-limited device 5 comprises two support rods 51. First ends of the two support rods 51 are respectively pivotally connected to the two bed surface frames 11, and second ends of the two support rods 51 are respectively pivotally connected to two ends of a sliding shaft 32 sliding along an up-down direction (i.e., corresponding to the z-axis in FIG. 16) in the sliding groove 31 disposed vertically on the second support leg 3 to define a slidable and pivotable connection. An upper groove wall of the sliding groove 31 defines a limiting mechanism 36 for limiting the second ends of the two support rods 51 (or the sliding shaft 32) from sliding upward beyond a highest position. The position-limited device 5 has the following advantages: (1) the two bed surface frames 11 are folded and unfolded synchronously due to the position-limited device 5; (2) the position-limited device 5 cooperatively enables the second support leg 3 to be pushed down with gravity to enable the two bed surface frames 11 to be maintained in the supporting state to achieve self-locking. Therefore, the second support leg 3 is prevented from swinging in a front-rear direction (also referred to as a left-right direction (i.e., corresponding to the x-axis in FIG. 14); and (3) there is need to abut the inner sides of the two bed surface frames 11 against each other to limit a rotation of each of the two bed surface frames 11, a distance between the inner side of each of the two bed surface frames 11 and a rotation axis of each of the two bed surface frames 11 can be decreased so as to decrease a protruding distance of the inner side of each of the two bed surface frames 11. Therefore, the packaging size of the foldable bed 100 can be decreased and assembly accuracy requirements can be reduced.

In this embodiment, each of the two bed surface frames 11 is connected with each of the two first support legs 2. Each of the two first support legs 2 comprises two supporting legs 21 and a connecting rod 24 extending and connected between the two supporting legs 21. The first linkage bar 41 and the second linkage bar 42 are respectively connected to each of the two supporting legs 21 and each of the two bed surface frames 11, and the two supporting legs 21 move synchronously. Each of the two first support legs 2 is formed with a first pivoting connection hole 25 penetrating therethrough. The first linkage bar 41 and the second linkage bar 42 respectively comprise a first penetrating hole 48, and one of two screw mechanisms 7 passes through the first pivoting connection hole 25 and the first penetrating hole 48 to achieve the abovementioned pivotable connection. Each of the two bed surface frames 11 is formed with a second pivoting connection hole 14 penetrating therethrough. The first linkage bar 41 and the second linkage bar 42 respectively comprise a second penetrating hole 49, and the other one of the two screw mechanisms 7 passes through the second pivoting connection hole 14 and the second penetrating hole 49 to achieve the abovementioned pivotable connection.

Embodiment 2

Referring to FIGS. 17-21, this embodiment is similar to the embodiment 1 but has the differences described below. A locking mechanism 6 is disposed and connected between each of the two bed surface frames 11 and each of the two first support legs 2 to enable each of the two first support legs 2 to be locked or unlocked in the supporting state so as to further improve safety performance. The locking mechanism 6 comprises a locking plate 61 configured to slide on each of the two bed surface frames 11, an elastic member 62 biasing the locking plate 61, and a protruding member 22 protruding on each of the two first support legs 2. The locking plate 61 comprises a locking hook 611 cooperating with the protruding member 22 to control the locking mechanism 6 to achieve locking or unlocking of the two first support legs 2 by sliding of the locking plate 61. Further, the locking plate 61 comprises a guiding surface 612. The protruding member 22 is configured to abut the guiding surface 612 to push the locking hook 611 to slide due to a movement of each of the two first support legs 2 to achieve automatic locking, and the elastic member 62 is pushed to achieve unlocking. In the embodiment, a base 13 is fixedly connected to the back of each of the two bed surface frames 11, and the locking plate 61 is slidably connected to the base 13. The locking mechanism 6 comprises a button 63 fixedly connected to the locking plate 61, and the elastic member 62 is disposed between the base 13 and the button 63 to generate an elastic force configured to drive the locking plate 61 from unlocking to locking.

Embodiment 3

Figure 22:
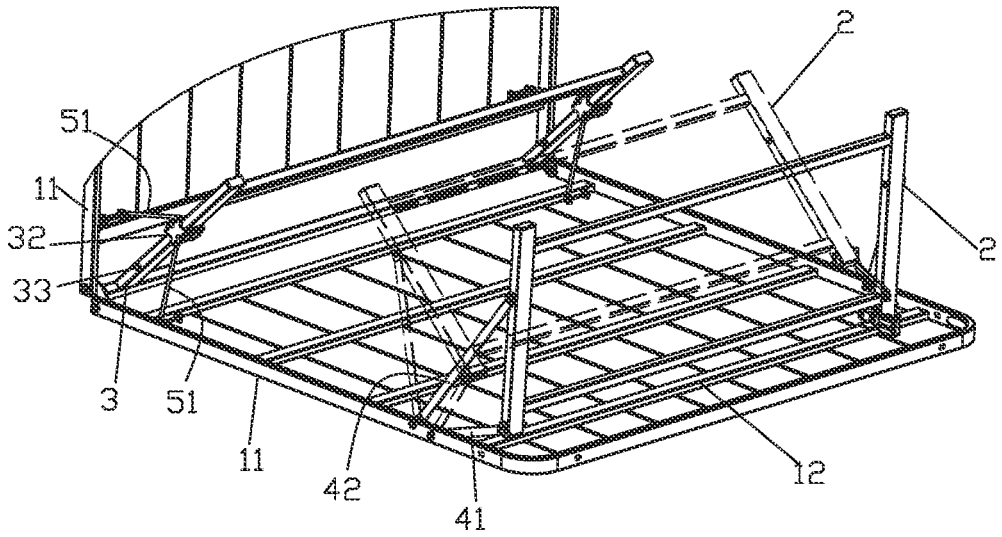
FIG. 22 illustrates an enlarged perspective view of the foldable bed according to embodiment 2.
Figure 23:
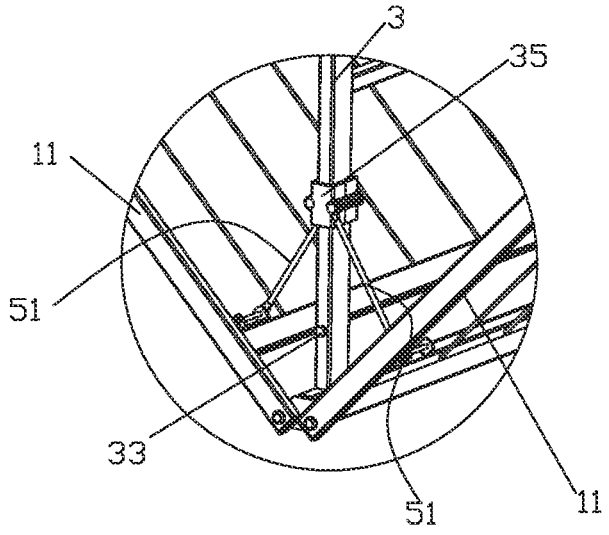
FIG. 23 illustrates a perspective view of a position-limited device according to embodiment 3.

Referring to FIGS. 22 and 23, this embodiment is similar to the embodiment 2 but has the differences described below. A sliding sleeve 35 is slidably connected to the second support leg 3. The second ends of the two support rods 51 are both pivotally connected to the sliding sleeve 35, and the second support leg 3 comprises a limiting protrusion 33 for limiting the sliding sleeve 35 from sliding upward beyond a highest position.

Embodiment 4

Figure 24:
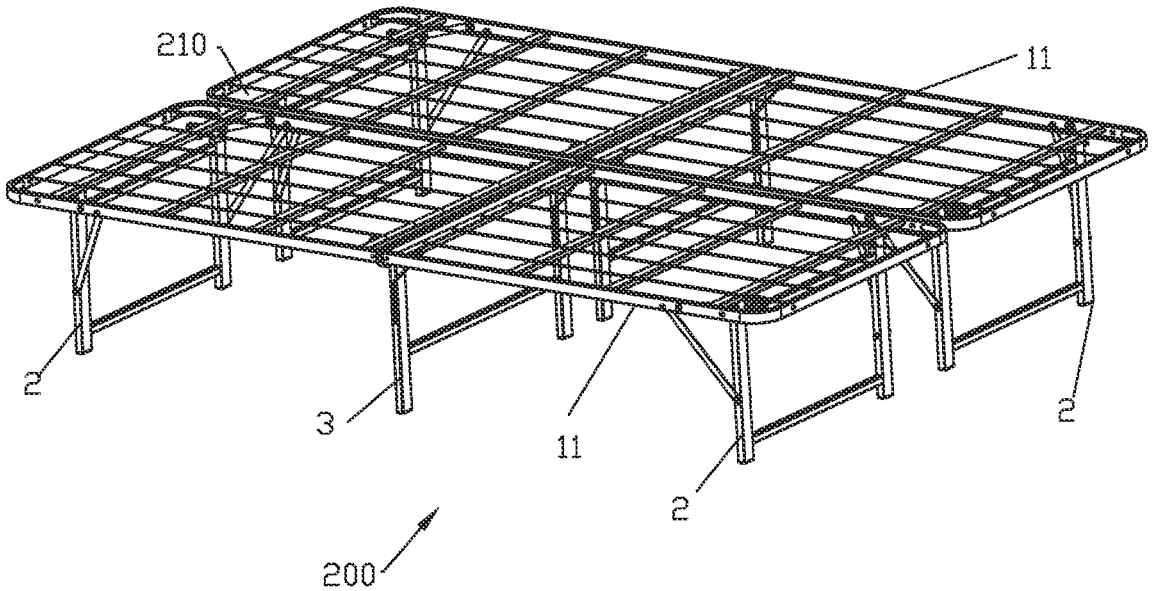
FIG. 24 illustrates a perspective view of a foldable bed according to embodiment 4.

Referring to FIG. 24, this embodiment is similar to the embodiments 1, 2, and 3 but has the differences described below. A foldable bed group 200 comprises two of the abovementioned foldable beds 100, and the foldable bed group 200 comprises an additional locking mechanism 210 for connecting the two of the abovementioned foldable beds 100 to define a larger bed in size or for disconnecting the abovementioned connection.

Embodiment 5

Figure 25:
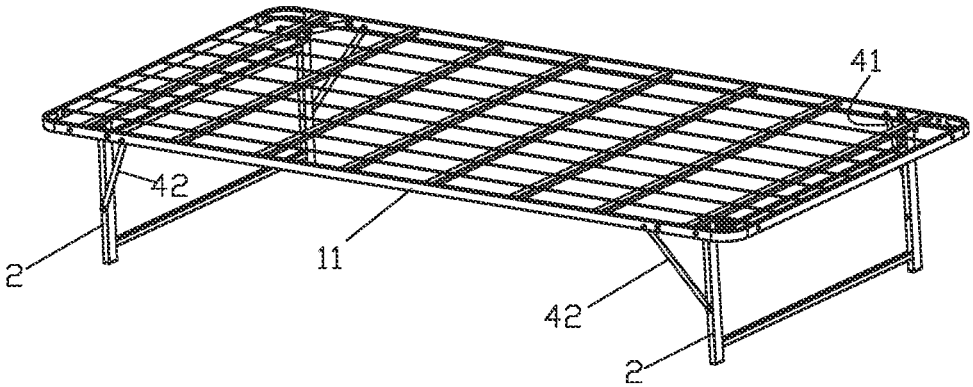
FIG. 25 illustrates a perspective view of a foldable bed according to embodiment 5.

Referring to FIG. 25, this embodiment is similar to the embodiments 1, 2, and 3 but has the differences described below. The bed surface unit 1 comprises only one said bed surface frame 11, and the two first support legs 2 are both connected to said bed surface frame 11.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A foldable bed, comprising:

a bed surface unit, one or more first support legs, a first linkage bar, a second linkage bar, and a second support leg, wherein:

the first linkage bar and the second linkage bar are respectively connected between the bed surface unit and the one or more first support legs, a length of the first linkage bar is shorter than a length of the second linkage bar, two ends of the first linkage bar are respectively pivotally connected to the bed surface unit and the one or more first support legs, two ends of the second linkage bar are respectively pivotally connected to the bed surface unit and the one or more first support legs, a first position on which the first linkage bar is pivotally connected to the one or more first support legs is higher than a second position on which the second linkage bar is pivotally connected to the one or more first support legs, a four-bar linkage is defined by the bed surface unit, the one or more first support legs, the first linkage bar, and the second linkage bar, the four-bar linkage is configured to be changed to be alternatively in a folded state or a supporting state, the bed surface unit comprises two bed surface frames, the second support leg is pivotally connected to inner sides of the two bed surface frames, at least one position-limited device is connected between the second support leg and the two bed surface frames, the position-limited device comprises two support rods, the second support leg comprises two legs, each of the two legs comprises a sliding groove penetrating a corresponding one of the two legs, first ends of the two support rods are respectively pivotally connected to the two bed surface frames, a sliding shaft is slidably disposed in the sliding groove with two ends of the sliding shaft protruding out of two openings of the sliding groove, second ends of the two support rods are respectively pivotally connected to the two ends of the sliding shaft sliding along an up-down direction in the sliding groove to define slidable and pivotable connections, when the four-bar linkage is in the folded state, the one or more first support legs are folded on a back of the bed surface unit, when the four-bar linkage is in the supporting state:

a top end surface of the one or more first support legs supports a bottom surface of the bed surface unit, a first triangular support structure is defined by the first linkage bar, the bed surface unit, and the one or more first support legs, and a second triangular support structure is defined by the second linkage bar, the bed surface unit, and the one or more first support legs, when the two bed surface frames are folded, the two support rods are accordingly folded due to a first sliding of the sliding shaft in the sliding groove, and when the two bed surface frames are unfolded, the two support rods are accordingly unfolded due to a second sliding of the sliding shaft of the sliding groove, wherein the first sliding is opposite to the second sliding.

2. The foldable bed according to claim 1, wherein:

the first linkage bar is pivotally connected to an upper part of the one or more first support legs.

3. The foldable bed according to claim 1, wherein:

the bottom surface of the bed surface unit is disposed with a support beam, and when the four-bar linkage is in the supporting state:

the top end surface of the one or more first support legs supports a bottom surface of the support beam, and the one or more first support legs are perpendicular to the bed surface unit.

4. The foldable bed according to claim 1, wherein:

a locking mechanism is connected between the bed surface unit and the one or more first support legs to enable the one or more first support legs to be locked or unlocked in the supporting state.

5. The foldable bed according to claim 4, wherein:

the locking mechanism comprises a locking plate configured to slide on the bed surface unit, an elastic member biasing the locking plate, and a protruding member protruding on the one or more first support legs, and the locking plate comprises a locking hook cooperating with the protruding member to control the locking mechanism to achieve locking or unlocking by sliding of the locking plate.

6. The foldable bed according to claim 5, wherein:

the locking plate comprises a guiding surface, and the protruding member is configured to abut the guiding surface to push the locking hook to slide.

7. The foldable bed according to claim 1, wherein:

the one or more first support legs are two first support legs, both sides of the bed surface unit are connected to the two first support legs, and the first linkage bar and the second linkage bar are respectively connected between the bed surface unit and each of the two first support legs.

8. The foldable bed according to claim 7, wherein:

each of the two bed surface frames is connected to each of the two first support legs.

9. The foldable bed according to claim 8, wherein:

a limiting mechanism for limiting the second ends of the two support rods from sliding upward beyond a highest position is disposed between the second ends of the two support rods and the second support leg.

10. The foldable bed according to claim 1, wherein:

two lugs are fixedly disposed symmetrically on an upper part of the second support leg along a left-right direction, the two lugs and the second support leg cooperatively define a T-shaped structure, and the inner sides of the two bed surface frames are respectively pivotally connected to the two lugs.

* * * * *